United States Patent [19]

Glover et al.

[11] Patent Number: 5,007,217

[45] **Date of Patent: * Apr. 16, 1991**

[54] MULTIPLE PANE SEALED GLAZING UNIT

[75] Inventors: Michael Glover; Gerhard Reichert, both of Ottawa, Canada

[73] Assignee: Lauren Manufacturing Company, New Philadelphia, Ohio

[ * ] Notice: The portion of the term of this patent subsequent to May 23, 2006 has been disclaimed.

[21] Appl. No.: 338,054

[22] Filed: Apr. 10, 1989

Related U.S. Application Data

[63] Continuation of Ser. No. 117,094, Nov. 5, 1987, abandoned, which is a continuation-in-part of Ser. No. 909,947, Sep. 22, 1986, abandoned.

[30] Foreign Application Priority Data

Sep. 21, 1987 [CA] Canada ..... 547355

[51] Int. Cl.[5] ..... E06B 7/12; E04C 2/54

[52] U.S. Cl. ..... 52/172; 52/171; 52/398; 52/789; 52/790

[58] Field of Search ..... 52/172, 398, 399, 789, 52/790, 171; 428/34

[56] References Cited

U.S. PATENT DOCUMENTS

| | | | |
|---|---|---|---|
| 3,758,996 | 9/1973 | Bowser | 52/172 |
| 4,092,812 | 6/1978 | Dashner et al. | 52/309.3 |
| 4,193,236 | 3/1980 | Mazzoni et al. | 52/398 |
| 4,194,331 | 3/1980 | Gingle et al. | 52/203 |
| 4,393,105 | 7/1983 | Kreisman | 52/788 |
| 4,622,249 | 11/1986 | Bowser | 52/172 |
| 4,649,685 | 3/1987 | Wolfe et al. | 52/398 |

FOREIGN PATENT DOCUMENTS

| | | | |
|---|---|---|---|
| 468939 | 10/1950 | Canada | 52/790 |
| 544321 | 10/1958 | Canada | 52/790 |
| 1203877 | 1/1960 | France | 52/790 |
| 411250 | 11/1966 | Switzerland | 52/790 |
| 868885 | 5/1961 | United Kingdom | 52/399 |
| 2044832 | 10/1980 | United Kingdom | 52/398 |
| 2065756 | 7/1981 | United Kingdom | 52/789 |

*Primary Examiner*—Michael Safavi

*Attorney, Agent, or Firm*—Wenderoth, Lind & Ponack

[57] ABSTRACT

There is described a multiple pane insulated sealed glazing unit having two or more glazing sheets which are maintained parallel and spaced apart by a resilient spacing and sealing assembly which runs around the periphery of the sheets. An insulating airspace is thus formed between the sheets. The assembly includes an inner spacer sandwiched between the sheets and located inwardly of the glazing edges, creating an outwardly facing perimeter channel. The inner spacer is comprised of a moisture permeable foam material which may be flexible or semi-rigid. The spacer contains desiccant material and has a pressure sensitive adhesive preapplied on two opposite sides adjacent the sheets. The inwardly directed face of the spacer is reistant to ultraviolet radiation and the spacer can be coiled for storage. The assembly also has an outer sealing filling in the channel. In a preferred embodiment the spacer is substantially backed with a flexible vapor and gas barrier coating, sheet or film.

7 Claims, 2 Drawing Sheets

MULTIPLE PANE SEALED GLAZING UNIT

This is a Rule 1.60 continuation of Ser. No. 07/117,094, filed on Nov. 5, 1987, which in turn is a continuation-in-part of application Ser. No. 06/909,947, filed Sept. 22, 1986, now abandoned.

BACKGROUND OF THE INVENTION

1. Field of the Invention

This application is a continuation in part of our application Ser. No. 909,947 filed Sept. 22, 1986. This invention relates generally to multiple pane sealed glazing units, and more particularly to multiple pane units having an insulating, flexible spacing and sealing assembly.

2. Description of the Prior Art

Insulating glass units generally consist of two or more parallel sheets of glass which are spaced apart from each other and which have the space between the panes sealed along the peripheries of the panes to enclose an air space between them. Spacer bars are placed along the periphery of the space between two panes. These spacer bars are typically long hollow perforated metal sections, usually made from an aluminum alloy and fabricated either in the form of an extrusion or by rolling from flat strip material. The hollow interior of the spacer contains a desiccant which is used to absorb any residual moisture that may be in the enclosed air and to soak up any additional moisture that may enter in the sealed unit over a period of time. The spacers are assembled into a rectangular frame typically using corner keys.

Units are constructed using either a single or dual seal. For single seal units, the structural, air and moisture vapour seal is combined in one seal. Sealant materials typically used with single seal design include either thermoplastic sealants such as butyl or thermosetting sealants such as polysulphide and polyurethane. In general, the thermosetting sealants are more permeable to moisture vapour than the thermoplastic sealants.

For dual seal units, there is an inner seal, as well as the main outer seal with the inner seal generally functioning as an additional moisture vapour seal. Typically, for dual seal units, the inner seal is a thermoplastic material such as polyisobutylene and a bead of the polyisobutylene is attached to the sides of the spacer adjacent to the glass sheets. The spacer frame is then placed between the panes and heat and/or pressure is applied to ensure that the polyisobutylene is compressed and fully wets out the surface of the glass. For the second outer seal, typically a thermosetting sealant such as silicone or polysulphide is used and is applied in the outward facing perimeter channel between the two glass sheets. Dual seal units are commonly used for automated production lines where the inner sealant is used as an adhesive holding the glass sheets in position on the conveyor line while the outer sealant cures.

To improve the thermal performance of multiple glazed sealed units increasingly units are being fabricated incorporating additional glazing sheets, where one or more of the parallel glazing sheets are being coated with a low-emissivity coating (low-e) to reduce radiation heat loss and the interconnected multiple airspaces are being filled with an inert gas such as argon to reduce conductive and convective heat loss.

Generally, conventional edge seal technology is inappropriate for high thermal performance units. There are a series of interrelated problems:

1. With conventional sealed units incorporating a conductive metal spacer, there is a thermal bridge between glazing layers and this can cause perimeter condensation and even ice build-up under extreme cold weather conditions.

2. With conventional sealed units, the percentage heat loss through the edge seal is about 5 percent of the overall heat loss through the window. For high thermal performance units incorporating conventional edge seal technology, the percentage heat loss is increased to 15 percent or more.

3. Low-e coatings intercept part of the solar spectrum causing the coated glazing to heat up. On cold, sunny days, the centre of the coated glazing can heat up and expand, but the expansion of the centre glass is constrained by the cold perimeter glass edge, creating stress in the glass sheet. Under extreme cold weather conditions, this thermal stress is sufficient to cause glass breakage.

4. Where low-e coatings are located on the inner glazing layers of multiple glazed units, the temperature within the airspaces of the sealed unit can be above 60° C. Because of these high temperatures, there are larger pressure fluctuations within the sealed unit, and these larger pressure fluctuations result in increased movement and bowing of the glass sheets which in turn results in increased glass and sealant stress.

5. With single seal, multiple glazed units incorporating an outer thermoplastic sealant, there can be seal failure and loss of structural integrity due to the more extreme temperatures within the sealed unit.

6. With improved high thermal performance glazing, the temperature difference between the inner and outer glazing is increased. The outer glazing may be −30° C. while the inner glazing is +16° C. As a result of this increased temperature difference, there is increased differential expansion between the inner and outer glazing sheets which in turn results in increased sealant stress.

7. If there is any condensation within the sealed unit due to partial failure of the edge seal, the high performance silver-based, low-e coatings, will rapidly oxidize turning white and opaque.

8. Sealants such as polyurethane and silicone are comparitively permeable to gases such as argon and over time there is a gradual loss of the low-conductive gas resulting in reduced thermal performance.

9. Low-e coatings, particularily solar control low-e coatings, intercept ultra-violet (UV) radiation and prevent the damaging UV radiation from entering the building interior. As a result, where low-e coatings are located on the interior or centre glazing sheets, there is a build-up of ultra-violet radiation within the sealed unit. Plastic materials located within the sealed unit can be degraded by exposure to these higher levels of UV radiation.

Although these problems are more critical for high thermal performance glazing, the same problems also effect to some degree the performance of the edge seal of conventional sealed double glazing units.

In the past, various efforts have been made in the prior art to use non-metallic materials for the spacer assembly.

U.S. Pat. No. 49,167 issued to Stetson describes the fabrication of multiple pane sealed units using wood or string as the inner spacer and putty as the outer sealant.

U.S. Pat. No. 2,340,469 issued to Hall describes the use of a thermoplastic spacer in combination with a metal foil vapour barrier and where the solid rigid plastic is adhered directly to the glazing sheets and no outer sealant is used to seal the unit.

U.K. Patent No. 868,885 issued to Midland Silicones Limited describes the use of silicone elastomeric spacers adhered to the glazing sheets by a curable silicone adhesive and where again no outer sealant is used to seal the unit.

U.S. Pat. No. 3,531,345 issued to Jameson describes how a compressible rubber seal can be used to simplify the construction of insulated glazing units for aircraft and space vehicles. The compressible seal reduces the need for manufacturing tolerance and prevents the liquid resin from leaking or smearing while the cast liquid resin cures to a hard material.

The common deficiency of the four spacing and sealing assemblies described above is that because the glazing units do not incorporate desiccant, over time, moisture vapour will build-up in the sealed unit causing condensation within the glazing unit which will gradually result in the formation of a white scum on the inner glazing faces due to leaching of salts from the glass.

U.S. Pat. No. 3,758,996 issued to Bowser describes the addition of desiccant material as a fill to a flexible but solid plastic spacer. The plastic spacer is backed by a layer of moisture resistant sealant typically thermoplastic butyl which extends across the spacer from the peripheral edge of one sheet to the peripheral edge of the other. The plastic spacer may be adhered to the glazing sheets with a rubber adhesive although polyisobutylene is typically used. The main drawbacks of this type of spacing and sealing assembly is that the process is slow, messy and complex. A further limitation is that this type of edge seal assembly can also only be used for double glazing.

U.S. Pat. No. 3,935,683 issued to Derner et al describes the use of a rigid plastic foam spacer. The rigid moisture permeable foam inner spacer which does not contain desiccant is used in combination with an outer spacer containing desiccant material within a solid profile. Again, the main drawback of this type of spacing and sealing assembly is the complexity of the assembly process for multiple glazed sealed units.

U.S. Pat. Nos. 4,226,063 and 4,205,104 issued to Chenel describes the use of a flexible spacing and sealing assembly comprising silicone as the outer sealant and desiccant-filled butyl sealant as the inner spacer which is extruded directly around the perimeter edge of the glass sheet.

In U.S. Pat. No. 4,622,249 issued to Bowser, the two materials are reversed and butyl is the outer sealant and desiccant filled silicone sealant is the inner spacer. The main drawback of both of these approaches is that very complex production equipment is required to fabricate the sealed units and that because of the complexity of the production process, the approach is effectively limited to only double glazed units.

As well as substituting non-metallic materials for the spacer assembly efforts have also been made in the prior art to develop simpler methods for manufacturing high performance glazing units.

U.S. Pat. No. 4,335,166 issued to Lizardo et al describes a method of manufacturing a sealed glazed unit incorporating a heat shrinkable plastic film, located between two outer glass sheets and which is typically surface coated with a low-e coating. A critical requirement is that to prevent wrinkles being formed at the corners following heat shrinking of the plastic film, the film must be held very rigidly in position. Typically, steel spacers are used in preference to aluminum because steel spacers are more rigid than aluminum. Although it is claimed by Lizardo et al that rigid plastic spacers could be used, it has been shown in practice that conventional solid plastic spacers are unsuitable because the spacers are not sufficiently stiff and rigid for this application.

U.S. Pat. No. 4,563,843 issued to Grether et al describes a method of manufacturing a thick airspace quad glazed unit. To achieve high thermal performance, the window incorporates multiple air spaces and two or more low-e coatings. To avoid the problem of pressure build-up within the thick airspace sealed unit, the unit is allowed to breath and a large quantity of desiccant material is used to ensure that moisture vapour is removed from the air entering the glazing unit.

One drawback with this design is the inconvenience and cost of occasionally replacing the desiccant material to ensure that no moisture vapour enters the glazing unit to degrade the low-e coatings. A second drawback is that because the unit breathes, it is impossible to incorporate low-conductive inert gas within the glazing unit. As a result and despite the complexity of the construction of the glazing unit, the thermal performance of the quad glazing unit is limited to only about RSI 1.4 (centre glazing).

SUMMARY OF THE INVENTION

The present invention provides a multiple pane insulated sealed glazing unit comprising two or more glazing sheets which are maintained in an essentially parallel and spaced apart relationship to each other by a peripheral resilient and insulating spacing and sealing assembly which encloses an insulating airspace between the glazing sheets. The spacing and sealing assembly is comprised of an inner spacer sandwiched between the glazing sheets and which is located inwardly of the edges of the glazing sheets, thereby creating an outwardly facing perimeter channel between the glazing sheets which is filled with sealant. The inner spacer is made from a moisture permeable flexible or semi-rigid foam material which incorporates desiccant material. The sides of the spacer are laminated with pressure sensitive adhesive and the front face of the spacer is UV resistant. A further important property of the spacer is that it is sufficiently flexible that it can be easily coiled.

The spacer is typically backed by a vapour and gas barrier. In fabricating a sealed unit, the foam spacer is typically applied around the perimeter of a glazing sheet in a single piece and the spacer is folded, notched or bent around the corners so that the vapour/gas barrier is continuous.

The vapour and gas barrier on the back of the spacer can be made from a variety of materials. The preferred design incorporates a barrier layer of vinylidene chloride polymers or copolymers (saran). Where moisture permeable materials are used for the outer sealant such as silicone or polysulphide a bead of material with very low moisture and gas permeability is applied at the junctions between the vapour barrier and the glazing sheets.

The foam spacer can be incorporated in multiple glazed sealed units in various ways. For multiple glazed units where there are one or more inner glazing sheets, the edge of the inner glazing can be inset so that the outer perimeter channel is defined by the outermost glazing sheets of the unit. This type of edge seal design is used particularily where the inner glazing sheet is a heat shrinkable plastic film.

For high thermal performance, multiple glazed sealed units should incorporate at least one low-e coating facing onto each airspace and the airspaces filled with a low conductive inert gas such as argon.

For quad glazed units to avoid the issue of pressure stress, the units can be filled with a low conductive gas such as krypton. The advantage of using krypton gas is that the spacing between the glazing sheets for good thermal performance can be reduced with the optimum spacing between each pair of glazing sheets being about 9.5 mm. The thermal performance of a quad glazed unit incorporating three low-e coatings and krypton gas fill is approximately RSI 2.1 to RSI 2.5 (centre glazing). In contrast, the thermal performance of conventional double glazing is RSI 0.35. For high thermal performance sealed units, the foam spacer offers nine advantages and these advantages reflect the previously identified problems with conventional edge seal technology for high thermal performance units.

1. Compared to metal spacers and even solid plastic spacer profiles, the foam spacer has a lower thermal conductivity. As a result, there is essentially no condensation around the perimeter of the glazing even under extreme cold weather conditions.

2. Because of the lower thermal conductivity of the foam spacer, the percentage heat loss through the perimeter zone for the overall glazing unit is reduced particularily for high thermal performance units.

3. The lower thermal conductivity of the foam spacer also results in substantially reduced thermal glass stress.

4. The foam spacer is also more resilient and flexible than solid plastic profiles. As a result of the resilience of the foam spacer, the increased movement and bowing of the glass sheets due to the larger pressure fluctuations within the sealed unit caused by higher temperatures can be accomodated without applying additional stress on the outer sealant.

5. Because of the resilience of the foam spacer, the increased differential expansion between the inner and outer glass sheets can also be accomodated without applying additional stress on the outer sealant.

6. Where thermoplastic materials are used for the outer sealant, the resilience of the foam spacer in combination with the structural adhesive on the sides of the foam spacer helps to ensure there is no loss of structural integrity or seal failure due to the more extreme temperatures experienced within thigh thermal performance sealed units.

7. When a sealant material such as polysulphide is stressed, its long term durability is substantially reduced. Because of the resilience of the foam spacer, the stress on the outer sealant is reduced, consequently increasing the long term durability and effectiveness of the edge seal.

Further, in order to prevent the excessive transmission of moisture vapour through the plastic spacer, the spacer must incorporate a high performance barrier coating especially when used in combination with moisture permeable sealants like silicone.

An edge seal design based on using butyl, polyisobutylene or a combination of the two as the outer sealant has a lower moisture permeability than a single seal design using thermosetting sealants.

8. The flexible foam spacer by increasing the durability and effectiveness of the edge seal, also helps prevent premature loss of the low conductive gas from the sealed units. Diffusion of the low conductive gas through the plastic spacer is also reduced by laminating the barrier backing with special coatings such as saran.

9. Most common plastic materials unless specially coated or stabilized cannot withstand prolonged exposure to the comparatively high levels of UV radiation which are achieved when the sealed unit incorporates low-e coatings on the interior or centre glazing layers. Where the spacer is made from silicone which has excellent ultra-violet resistance, there is no need for these specialized coatings or UV stabilizers.

BRIEF DESCRIPTION OF DRAWINGS

The following is a description by way of example of certain embodiments of the present invention, reference being had to the accompanying drawings, in which.

It should be noted that the cross-sections of insulated glazed sealed units show one representative cross-section through the edge of the sealed unit and location plans for these cross-sections are not given.

DETAILED DESCRIPTION

For the different sealed unit designs illustrated herein for double, triple, and quad sealed units, it is recommended for improved high thermal performance, that the airspaces are filled with inert gas fill and one glazing surface in each separate airspace is coated with a high performance low-emissivity coating. To avoid repetition in the description of the drawings, specific reference is not made in each case that the sealed units may incorporate these features. It should also be noted that in this document, the space enclosed by the spacer and glazing sheets is referred to as an airspace, and that this specifically does not exclude the possibility that the space is filled with an inert gas such as argon. For good thermal performance, where air or argon gas is used, the optimum spacing between the glazing layers is about 12.5 mm. Further, it should be noted that the drawings illustrate only a small representative sample of some of the possible applications and design configurations of the foam spacer for multiple glazed sealed units.

Figure 1:
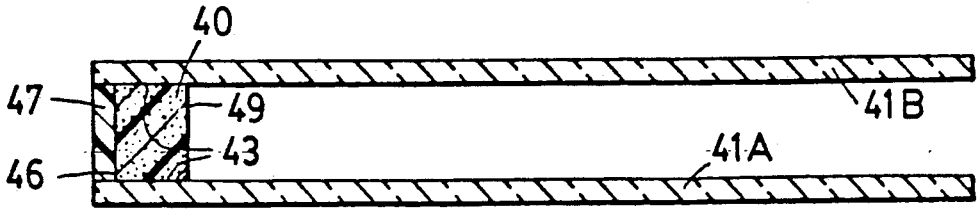
FIG. 1 shows a cross-section through a single seal, double glazed unit incorporating the foam spacer.

Referring to the drawings, FIGS. 1 to 3 show the plastic foam spacer for double glazed units. FIG. 1 shows a cross-section of a single seal double glazed unit. The flexible or semi-rigid foam spacer 40 can be manufactured from thermoplastic or thermosetting plastics. Suitable thermosetting plastics include silicone and polyurethane. Suitable thermoplastic materials include thermoplastic elastomers such as Santoprene. The preferred material is silicone foam. The advantages of the silicone foam include: good durability, minimal outgassing, low compression set, good resilience, high temperature stability and cold temperature flexibility. A further major advantage of the silicone foam is that the material is moisture permeable and so moisture vapour can easily reach the desiccant material within the foam.

During the production of the foam, desiccant is added as a fill. The type of desiccant material used is typically 3A molecular sieve zeolites to remove moisture vapour and in addition smaller amounts of 13X molecular sieves, silica gel or activated carbon are used to remove organic vapours. Overall, the amount of desiccant material to be used should match the amount of desiccant material that is typically incorporated in a conventional sealed glazing unit.

The inner face 49 of the foam spacer must be UV resistant so that the plastic foam does not dust or flake after prolonged exposure to sunlight. To provide the necessary long term durability and depending on the plastic material used, various specialized measures may be taken including adding UV stabilisers to the plastic material and covering or coating the front face of the foam spacer. For durable plastic materials such as silicone, because of their excellent UV resistance, there is no need to specially coat or cover the inner face of the foam spacer.

Pressure sensitive adhesive 43 is preapplied to opposite sides of the foam spacer. In selecting a suitable adhesive, there are five main criteria: high tack, shear strength, heat resistance, UV resistance, and non-outgassing. For the silicone foam spacer although various adhesives can be used, the preferred material is a UV resistant pressure sensitive acrylic adhesive. The acrylic adhesive should be UV resistant, non-outgassing and for Heat Mirror units should have high temperature stability.

Depending on the moisture and gas permeability of the sealant used, the foam spacer may have a vapour and gas barrier 46 applied to its back face. This barrier may be a coating applied directly to the foam spacer or a separate sheet adhered to the foam spacer. The vapour barrier may be a metal foil, plastic sheet, or metalised plastic film. For thermosetting sealants such as polysulphide, it is important that the sealant bonds strongly to the vapour barrier and to ensure good adhesion, it may be necessary for the vapour barrier to be treated with a suitable primer.

For gas filled units, the barrier must also prevent the low conductive inert gas from diffusing from the sealed unit. One material that has a particularily low gas permeability is vinylidene chloride polymers and copolymers (saran). To achieve a barrier that has both very low moisture and gas permeabilities, the barrier may be laminated from different materials. The preferred material for the barrier film is a metalised PET film with a saran coating on both sides. Experiments have shown that most common sealants bond very strongly to the saran coating.

Where thermosetting sealants are used for the outer sealant 47 which are comparatively permeable such as polysulphide and polyurethane, the foam spacer must be backed by a separate vapour and gas barrier. Where thermoplastic sealants are used for the outer sealant 47 which have a very low moisture and gas permeability such as butyl or polyisobutylene there is no need for a separate vapour and gas barrier. For thermoplastic sealants, the advantage of using the flexible foam spacer with the preapplied adhesive is that the foam spacer structurally holds the glazing sheets in position and there is no problem of cold creep. Where there is an extreme temperature build-up within the sealed unit, the foam spacer maintains the mechanical stability of the unit even though the thermoplastic sealant may soften and lose some structural performance.

The foam spacer combines or replaces four conventional components of a sealed glazing unit—desiccant, hollow metal spacer, corner keys and inner adhesive—into a single component. In comparison with conventional methods, the production process for manufacturing multiple glazed units is simple, quick and clean. For small, local sealed unit manufacturers, a particular advantage of the foam spacer is that no specialized equipment is required. For large sealed unit manufacturers with automated production lines, the foam spacer can be very quickly applied because of the tacky pressure sensitive adhesive on the sides of the spacer. The foam spacer can very easily be cut by a knife and by using an acrylic pressure sensitive adhesive as opposed to a sticky thermoplastic sealant such as polyisobutylene, the knife blade does not become messy and contaminated.

In the production process of the sealed unit, the foam spacer 40 is laid down on the first sheet of glass 41A so that the glass extends beyond the spacer by about 6 mm. The foam spacer is adhered around the perimeter of the glass sheet with the pressure sensitive adhesive 43. The flexible or semi-rigid foam spacer can easily be cut with a knife blade and instead of assembling the spacer frame from measured and precut pieces, the foam spacer is laid directly in position on the glass and cut to size as required. The second glass sheet 41B is placed on top of the foam spacer 40 and the glass is again adhered to the foam spacer with pressure sensitive adhesive 43. After the second glass sheet has been placed on the foam spacer, sealant 47 is applied in the open channel between the glass sheets 41 and behind the foam spacer 40.

By using the resilient silicone foam, the spacer can easily be laid out in a straight line on the glazing without any kinks in the spacer even after being packaged in a coil for a prolonged period of time. The resilience of the silicone foam spacer also ensures that the glass sheets are uniformly spaced when the sealed units are being assembled. Experiments have shown that even with large size quad glazed units, the silicone foam is sufficiently resilient to ensure uniform spacing between the parallel glazing layers. Because of the cellular structure of the foam, the spacer also ensures uniform spacing between the glazing layers for curved or "bent" multiple pane sealed units.

Figure 2A:
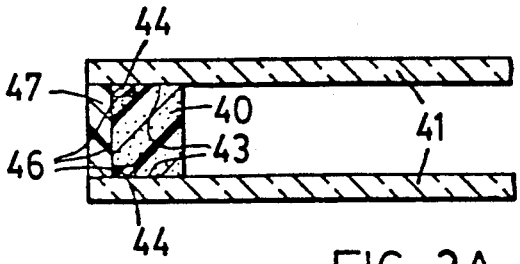
FIGS. 2A and 2B show alternative cross-sections through a dual seal, double glazed unit incorporating the foam spacer.
Figure 2B:
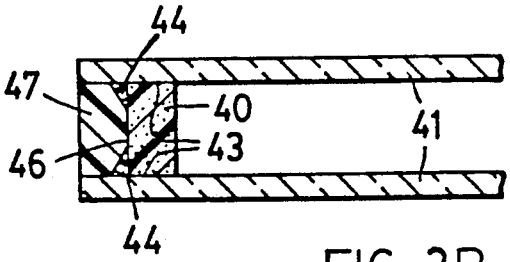

FIGS. 2A and 2B illustrate two alternative designs for dual seal, double glazed units. In each design, the foam spacer 40 is substantially backed with a vapour sheet or coating 46 and the unit sealed with an outer thermosetting sealant such as silicone. Because the outer sealant is comparatively permeable, it must be used in combination with an inner sealant 44 which has a very low vapour and gas transmission rate. The alternative spacer designs shown in FIGS. 2A and 2B vary depending on how the inner sealant is applied to the glass.

In FIG. 2A the semi-rigid or flexible foam spacer 40 is substantially T-shaped in section with a top-hat shaped vapour barrier sheet backed with a separate vapour barrier sheet 46 which overlaps the top-hat profile so that the edges of the backing sheet are flush with the sides of the spacer creating channels on either side of the spacer which are filled with soft sticky sealant 44. Pressure sensitive adhesive 43 is pre-applied to both sides of the T-shaped foam spacer 40 where the foam spacer contacts the glass. When the two sheets of glass 41 are compressed together, the foam spacer 40 is compressed and the soft sealant 44 is forced against the glass sheets 41 creating a fully wetted bond at the sides.

In FIG. 2B, the semi-rigid or flexible foam spacer is rectangular in section and a small bead of the sealant 44 is applied at the two junctions between the vapour/gas barrier and the glazing sheets 41. The sealant bead can be made from any self adhering material that has low gas and moisture permeability including polyisobutylene, saran, and epoxy adhesives.

Figure 3A:
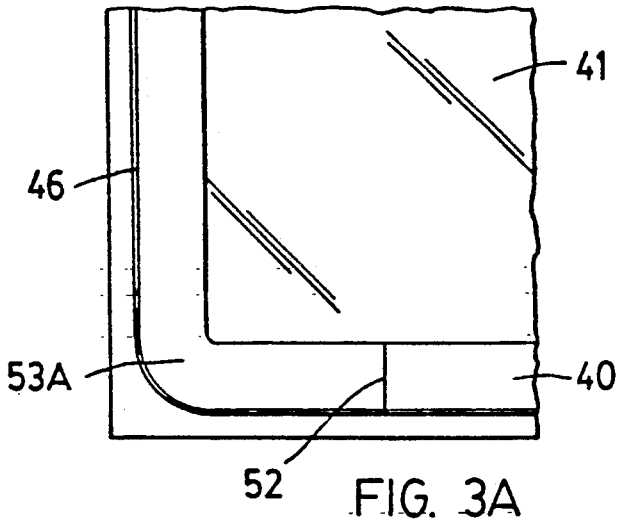
FIGS. 3A, 3B and 3C show plan views of foam spacers placed on top of a glass sheet illustrating three alternative corner details.
Figure 3B:
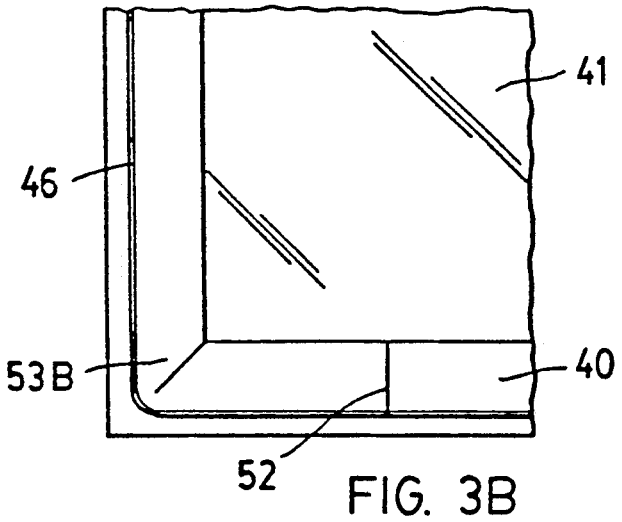
Figure 3C:
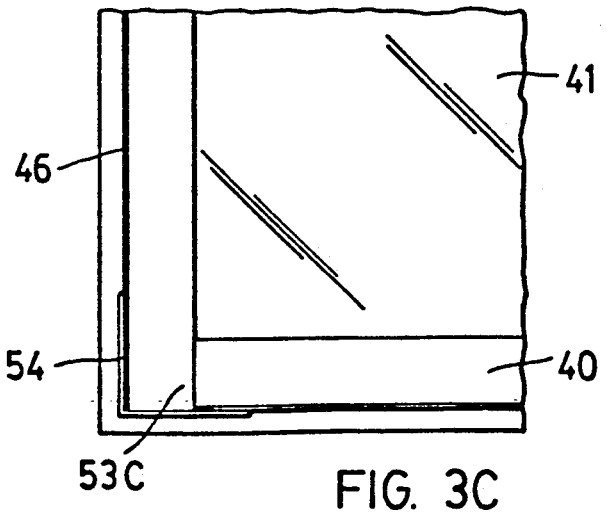

FIG. 3 shows alternative corner details for a foam spacer which is adhered to a glass sheet 41. For a foam spacer, here a flexible foam spacer 40 as shown in FIG. 3A, the spacer is simply bent or folded at the corner 53A. Alternatively, as shown in FIG. 3B, a V notch joint 53B can be cut or punched out so that the flexible spacer or semi-rigid spacer 40 can be folded around the corner while maintaining the continuity of the vapour barrier 46. For FIG. 3A and FIG. 3B, the foam spacer 40 is typically applied as a single piece around the perimeter edge of the glazing sheet 41 and the two ends of the foam spacer strip form a single butt joint 52. As shown in FIG. 3C, the spacers are butt jointed at the corners 53C and vapour barrier tape corner pieces 54 applied to ensure the continuity of the vapour barrier. Especially for Heat Mirror units, applying the corner tape pieces is a very slow awkward process and durability testing has indicated that the corner tapes may be eliminated with apparent minimal impact on the long term performance of the sealed units.

Figure 4:
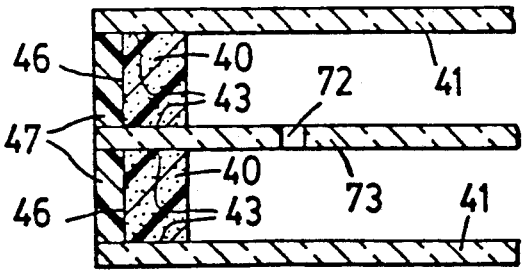
FIG. 4 shows a cross-section through a single seal, triple glazed unit incorporating a rigid inner sheet.

FIG. 4 shows a cross-section of a single seal triple glazed sealed unit with two outer glazing sheets 41 and an inner rigid glazing sheet 73. The glazing sheets are spaced apart by two foam spacers 40 containing desiccant fill which are adhered to the glazing sheets with pressure sensitive adhesive 43. The unit is sealed with a single seal, outer sealant 47. Alternatively, the unit could be sealed with a dual seal as previously described in FIG. 2. The two airspaces between the three glazing layers may be interconnected by means of an optional hole 72 typically drilled in the inner glazing layer 73.

Figure 5:
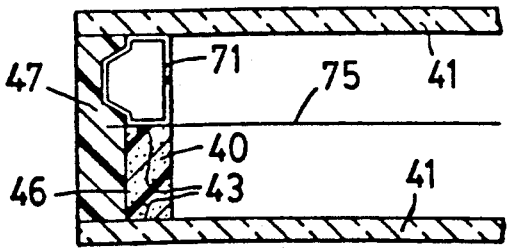
FIGS. 5 and 6 show cross-sections of alternative configurations for single seal, triple glazed sealed units incorporating a heat shrinkable inner glazing film.
Figure 6:
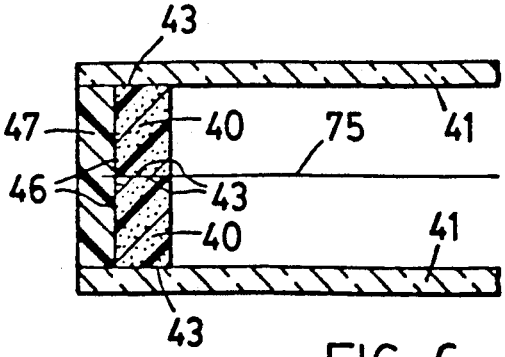

FIGS. 5 and 6 show two alternative designs for a single seal triple glazed unit with an inner heat shrinkable plastic film 75. The thin flexible plastic inner film 75 is typically made from polyethylene terephthalate (PET) and is coated with a low-emmissivity coating. One suitable product is manufactured by Southwall and is sold under the trade name of Heat Mirror.

FIG. 5 shows a conventional metal T-shaped "Heat Mirror" spacer 71 in combination with a foam spacer 40 which typically contains desiccant. The preassembled metal spacer frame is laid on top of the plastic film and the film is adhered to the spacer with high temperature pressure sensitive acrylic adhesive. The film is then cut to size in the conventional way so that about 3 or 4 mm of material extends into the groove created by the T-shaped metal spacer 71. The foam spacer 40 is then laid on top of the flexible film in line with the metal spacer below and adhered to the film with preapplied pressure sensitive adhesive 43. The PET film, metal and foam spacer combination is then sandwiched between the two glass sheets 41. The outward facing perimeter channel is filled with a high modulus, single seal sealant 47 typically polyurethane sealant. The sealant bonds strongly to the film and glass sheets and the film is held firmly in position. The flexible film is then tensioned by the conventional heat shrinking methods. These methods are generally described in U.S. Pat. No. 4,335,166 and typically involve placing the unit in an oven and slowly heating the unit to between 100° C. and 110° C.

Even though a flexible or semi-rigid foam spacer is used for the Heat Mirror units, experiments have shown that even with long, thin, oblong-shaped sealed units, there are no problems with corner wrinkling due to differential tensioning of the film in different directions. It appears that the film is held rigidly in place by the outer sealant and the resilience of the foam spacer seems to help eliminate the problem of corner wrinkling.

FIG. 6 shows an alternative design for a triple glazed unit incorporating a heat shrinkable flexible film 75 where two foam spacers 40 are used. The foam spacers are rectangular in cross-section and are backed with a vapour barrier 46. The heat shrinkable film extends approximately 3 mm to 6 mm beyond the foam spacers and is held in place by a high modulus sealant 47.

Figure 7:
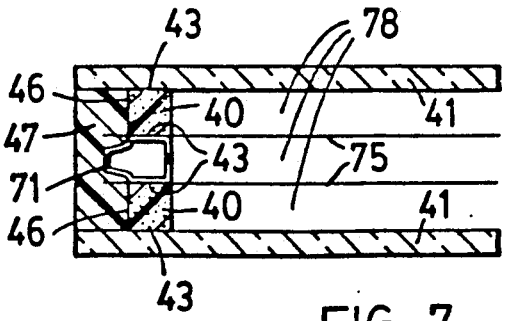
FIG. 7 shows a cross-section of a slim line, quad glazed unit incorporating two inner heat shrinkable films and filled with low conductive krypton gas.

FIG. 7 shows a single seal quad glazed unit incorporating two inner heat shrinkable flexible films 75 and krypton gas fill 78. The advantage of using krypton gas is that the optimum spacing between the glazing sheets for good thermal performance can be reduced from about 12.5 mm to 9.5 mm or less. For quad glazed units the particular advantage of using krypton gas, is that a very high thermal performance can be obtained without having to address the pressure stress issue of thick airspace units.

As shown in FIG. 7, the quad glazed unit incorporates two heat shrinkable plastic film glazings 75 which are adhered to a conventional metal spacer 71 using a pressure sensitive adhesive 43. On either side of the metal spacer, there is a foam spacer 40 typically containing desiccant and backed with moisture vapour and gas barrier 46. The sealed unit is constructed using essentially the same method as previously described in FIG. 5 except of course the unit incorporates an additional flexible film 75 and foam spacer 40. The three interconnected airspaces are filled with a very low conductive gas 78 which is typically krypton. Depending on the type and number of low-e coatings, the thermal performance of a quad glazed unit filled with krypton gas can range from RSI 1.75 to RSI 2.45.

What is claimed is:

1. A multiple plane insulating sealed glazing unit comprising two or more glazing sheets, said sheets being maintained in an essentially parallel and spaced apart relationship to each other by a peripheral resilient spacing and sealing assembly, defining an insulating airspace between said sheets, which spacing and sealing assembly comprises an inner spacer strip sandwiched between said sheets, and located inwardly of the glazing edges, thereby creating an outwardly facing perimeter channel therebetween;

said inner spacer strip being composed of a moisture permeable flexible or semi-rigid silicone foam material preformed to have, when in the uncompressed condition, two opposite sides spaced so as to provide the desired spacing of said glazing sheets and containing desiccant material, said spacer strip having a preapplied ultra-violet resistant pressure sensitive adhesive on said opposite sides thereof and which abut said sheets, said adhesive having high tack and non-outgassing properties and said spacer strip having an inwardly directed face which is resistant to ultra-violet radiation, and having physical properties which permit said spacer strip to be coiled for storage; and said spacing and sealing assembly further comprising an outer sealant filling said outer perimeter channel.

2. A unit as claimed in claim 1 where said foam spacer strip is substantially backed with a flexible vapor and gas barrier coating, sheet or film and where the spacer strip is capable of being folded, notched or bent around corners so that the vapor and gas barrier is continuous.

3. A unit as claimed in claim 2 where the outer sealant is moisture permeable and where a bead of self adhering material of very low moisture and gas permeability is applied between said vapor barrier and said sheets.

4. A unit as claimed in claim 1 wherein in addition to said at least two glazing sheets, at least one further glazing sheet is provided parallel to and spaced between said at least two glazing sheets to define at least one further airspace, said inner spacer strip being located between at least one adjacent pair of glazing sheets and said outwardly facing perimeter channel being defined by the outermost glazing sheets of the unit.

5. A unit as claimed in claim 4 in which said further glazing sheet is composed of heat shrinkable plastic film.

6. A unit as claimed in claim 1 in which at least one of said glazing sheets is surface coated with a low-emissivity coating and wherein said insulating airspace is filled with a low conductive gas.

7. A unit as claimed in claim 4 in which at least one of said glazing sheets is surface coated with a low-emissivity coating and wherein said insulating airspace is filled with a low conductive gas.

* * * * *